United States Patent [19]

Berkowitz et al.

[11] 4,012,180

[45] Mar. 15, 1977

[54] ROTARY COMPRESSOR WITH LABYRINTH SEALING

[75] Inventors: Murray Berkowitz, Woodcliff Lake; George H. Woodier, Ringwood, both of N.J.

[73] Assignee: Curtiss-Wright Corporation, Wood-Ridge, N.J.

[22] Filed: Dec. 8, 1975

[21] Appl. No.: 638,646

[52] U.S. Cl. ..... 418/141; 418/129

[51] Int. Cl.[2] ..... F01C 19/02

[58] Field of Search ..... 418/61 A, 141, 125, 418/129

[56] References Cited

UNITED STATES PATENTS

| | | | |
|---|---|---|---|
| 974,803 | 11/1910 | Lukacsevics | 418/141 X |
| 2,856,120 | 10/1958 | Fawzi | 418/141 |
| 2,988,008 | 6/1961 | Wankel | 418/61 A X |
| 3,174,274 | 3/1965 | Frye | 418/141 X |
| 3,764,239 | 10/1973 | Huf | 418/61 A |

FOREIGN PATENTS OR APPLICATIONS

| | | | |
|---|---|---|---|
| 1,008,529 | 2/1952 | France | 418/141 |
| 2,060,067 | 5/1972 | Germany | 418/61 A |
| 583,035 | 12/1946 | United Kingdom | 418/61 A |

*Primary Examiner*—Carlton R. Croyle
*Assistant Examiner*—Michael Koczo, Jr.
*Attorney, Agent, or Firm*—Victor D. Behn; Arthur Frederick

[57] ABSTRACT

A rotary trochoidal compressor comprising a rotor mounted for planetary motion within a housing and in which the periphery of the compressor rotor is substantially a hypotrochoid and the peripheral inner surface of the housing is the outer envelope of the rotor and in which labyrinth seal means is provided between the rotor and housing.

10 Claims, 12 Drawing Figures

FIG. 3
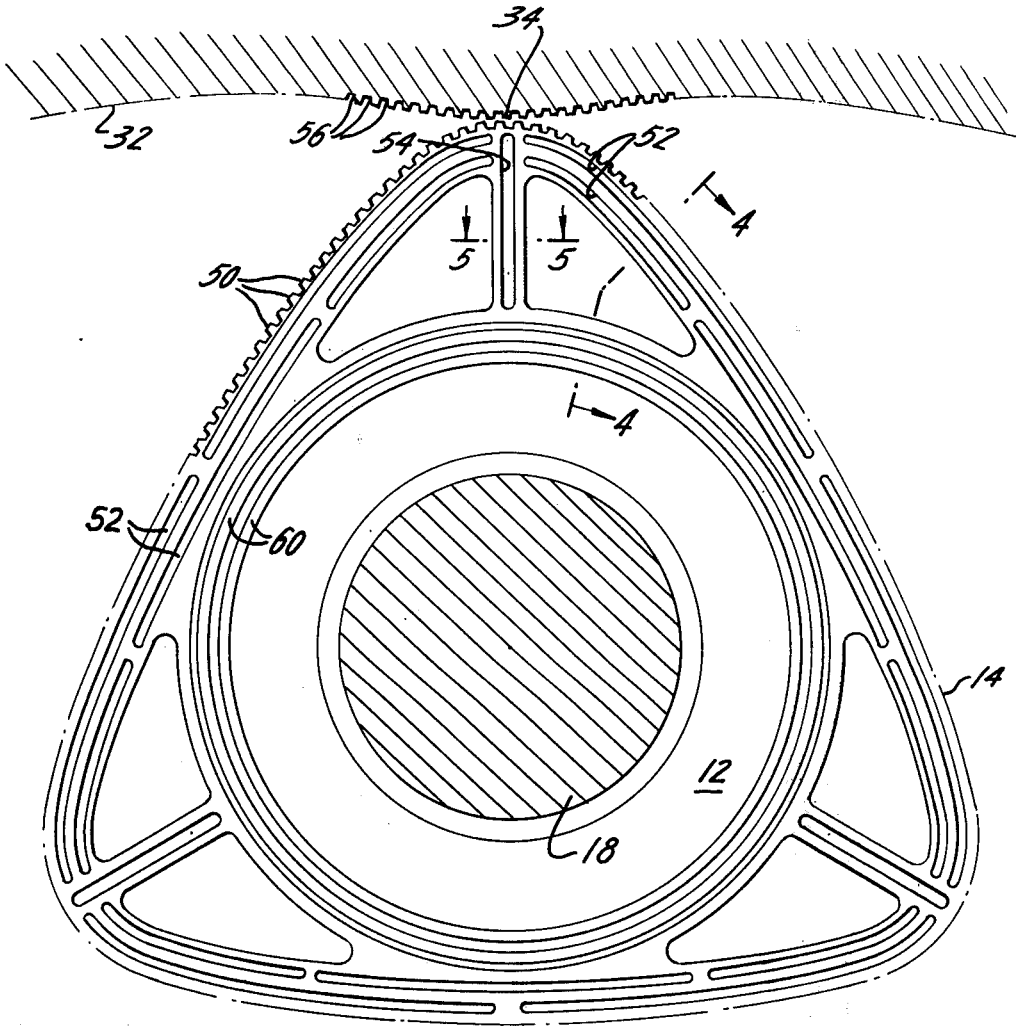
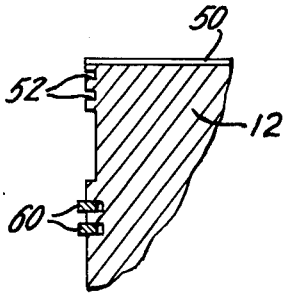
FIG. 4
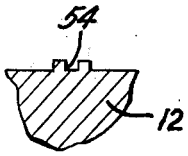
FIG. 5

FIG. 6
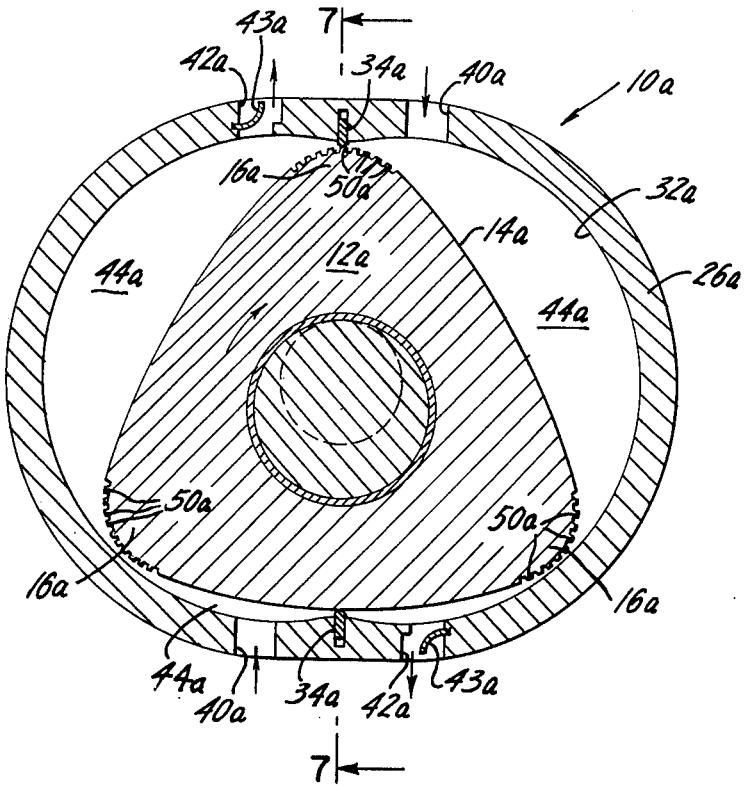
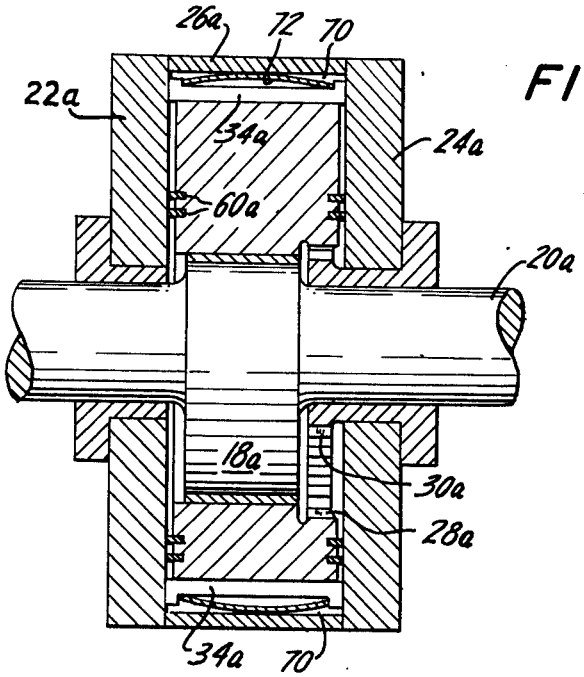
FIG. 7

FIG. 10
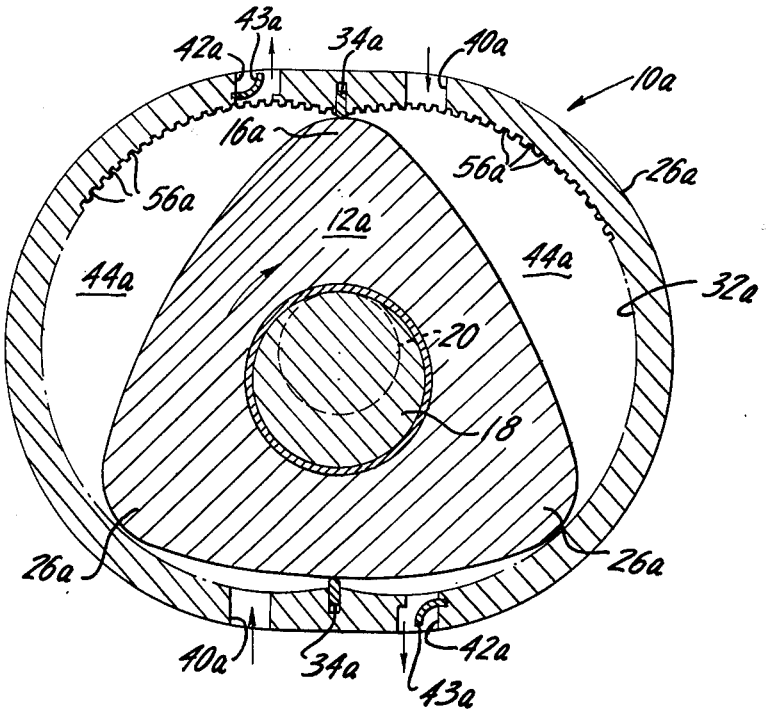
FIG. 11
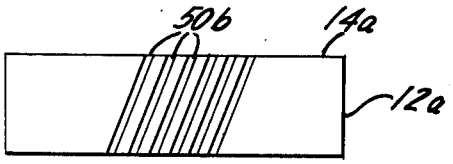
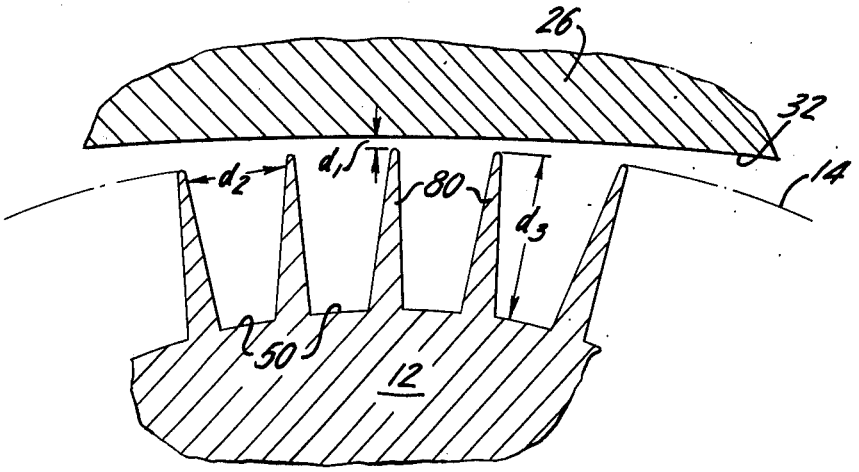
FIG. 12

ROTARY COMPRESSOR WITH LABYRINTH SEALING

BACKGROUND OF THE INVENTION

The invention relates to rotary mechanisms, particularly to rotary compressors or expansion engines in which the rotor has a planetary motion within a housing and the peripheral surface of the rotor is substantially a hypotrochoid and the inner surface of the housing is substantially the outer envelope of the relative rotary motion of the rotor. Such a compressor or expansion engine is disclosed in U.S. Pat. No. 3,387,772 granted June 11, 1968 to Wutz and in British Pat. No. 583,035 granted on Dec. 5, 1946 to Maillard and is generally known as a Maillard-type compressor. The invention will herein be described in terms of compressor operation although as will be apparent it is also applicable to expansion engines.

Various trochoidal-type compressors have been proposed in the part in which either the outer periphery of the rotor or the inner periphery of the rotor housing is a trochoidal surface, either an epitrochoid or a hypotrochoid. For example, U.S. Pat. No. 3,671,153 granted on June 20, 1972 to Luck shows a compressor in which inner surface of the rotor housing is an epitrochoid. A rotary mechanism having the geometry of the rotor and rotor housing shown in the Luck patent is generally known as a Wankel-type rotary mechanism. It has been determined that a Maillard-type compressor has the advantage in that the minimum volume of each working chamber is reduced substantially to zero at the end of the discharge stroke of each working chamber thereby providing a compressor with high volumetric efficiency.

The efficiency of a rotary compressor depends on the provision of adequate sealing for each working chamber. In a Maillard-type compressor, it is essential to provide sealing between each rotor nose portion and the inner periphery of the rotor housing as well as between the point or points on the rotor housing periphery which generate or trace the hypotrochoid surface of the rotor as the rotor rotates relative to the housing. However, in the case of a Maillard-type compressor, each rotor nose or apex portion, instead of being pointed as in a Wankel-type configuration, is rounded and the seal contact line with the rotor housing shifts about the rounded nose portion as the rotor rotates relative to the rotor housing. Therefore, in the case of a Maillard-type compressor, a radially movable seal bar carried in a slot extending axially across the nose portion of the rotor would have to shift radially relative to the rotor to maintain seal contact with the rotor housing. Any such required radial motion of the rotor apex or nose seals necessarily reduces the effectiveness of the seal since because of friction forces and the short response time, the seal may not maintain seal contact with the rotor housing. Also, such required seal motion would increase the amount of lubrication required to minimize seal wear.

SUMMARY OF THE INVENTION

It is an object of the invention to provide a Maillard-type of rotary compressor with a novel and simple sealing arrangement for the compressor working chambers.

In accordance with the invention, the compressor is provided with a novel labyrinth seal configuration. The use of labyrinth seals not only avoids seal contact friction but thereby eliminates the need for seal lubrication. This latter feature is particularly important in a compressor application in which it is desired to minimize the quantity of lubricating oil which becomes entrained in the compressed fluid delivered by the compressor. Also, the absence of any seal contact friction in a labyrinth seal configuration insures long seal life.

More specifically, it is an object of the invention to provide a novel labyrinth seal configuration for a Maillard-type compressor in which the rotor periphery and sides are provided with labyrinth grooves to provide a seal between the rotor and compressor housing. In addition, or in lieu of providing labyrinth grooves on the rotor periphery, it is also within the scope of the invention to provide labyrinth grooves on the inner peripheral surface of the rotor housing.

In order to reduce the leakage across the labyrinth seals, the physical clearance between the relatively movable seal parts should be kept to a minimum. For this purpose, the tips of the ribs or teeth forming the labyrinth seal grooves may be designed to be slightly oversize so that they wear in during initial operation of the compressor. U.S. Pat. No. 3,086,476 granted Apr. 23, 1963 to Weiss, discloses a rotary vane pump in which the pump housing is provided with a fibrous layer which is worn in by the pump vanes. The Weiss patent, however, discloses a totally different type of rotary apparatus in which the fluid is merely transported from the inlet to the outlet side of the pump. That is, the Weiss patent does not disclose a compressor which, as in a Maillard-type compressor, has internal working chambers which vary in volume to compress the fluid and, therefore, requires a seal grid around each such chamber of the compressor.

In another embodiment of the invention, the point or points on the rotor housing which generate the hypotrochoid periphery of the rotor are provided with a radially movable seal bar which extends axially across the housing and contacts the periphery of the rotor. In addition, the nose or apex portions of the rotor periphery are provided with labyrinth-type recesses to provide a seal between said rotor nose portions and the rotor housing. In this embodiment the rotor periphery instead of being a true hypotrochoid preferably is a curved surface parallel to a true hypotrochoid and spaced radially inwardly from the true hypotrochoid a distance approximately equal to the radius of curvature of the sealing tip of said seal bar.

Other objects of the invention will become apparent upon reading the following detailed description in connection with the drawings.

BRIEF DESCRIPTION OF THE DRAWINGS

FIG. 3 is an enlarged view of a portion of FIG. 1 and illustrating an end face of the rotor, FIGS. 4 and 5 are sectional views taken along line 4—4 and 5—5 of FIG. 3, FIG. 6 is a view similar to FIG. 1 but showing a modified form of the invention, FIG. 7 is a sectional view taken along line 7—7 of FIG. 6, FIG. 10 is a view similar to FIG. 6 but illustrating a further modification of the invention, FIG. 11 is a plan view of the rotor of FIG. 8 but illustrating a modified labyrinth groove configuration from that shown in FIG. 8, and FIG. 12 is a highly enlarged cross-sectional view illustrating preferred dimensions of labyrinth grooves on the rotor.

DESCRIPTION OF PREFERRED EMBODIMENTS

Figure 1:
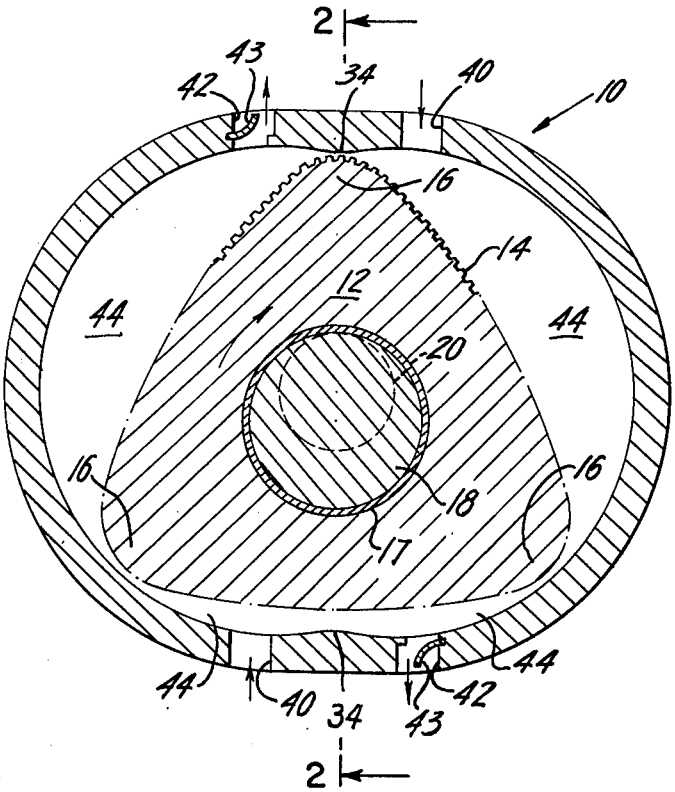
FIG. 1 is a transverse sectional view of a rotary compressor embodying the invention.
Figure 2:
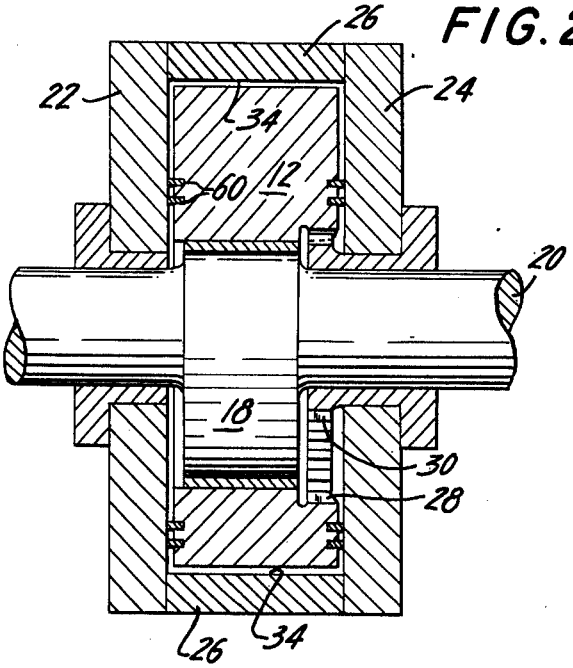
FIG. 2 is an axial sectional view taken along line 2—2 of FIG. 1.

Referring first to FIGS. 1 and 2 of the drawings which discloses a rotary compressor 10 in which the inner body or rotor 12 of the compressor has a peripheral surface 14 which is a hypotrochoid having three apex or nose portions 16. The rotor 12 is rotatably journaled by a bearing 17 on the eccentric portion 18 of a shaft 20 which is coaxially supported in an outer body or housing consisting of a pair of axially-spaced end walls 22 and 24 and an intermediate peripheral wall or rotor housing 26. The housing walls 22, 24 and 26 are suitably secured together as by bolts (not shown).

The rotor 12 has an internal gear 28 secured to one end face of the rotor and disposed in mesh with a gear 30 secured to the adjacent housing end wall 24. The gears 28 and 30 in effect form the rolling circles for generating the hypotrochoid surface 14. For generating a hypotrochoid having three apex portions as illustrated, the gears 28 and 30 are provided with a diameter ratio of 3:2.

The inner peripheral surface 32 of the intermediate or rotor housing 26 is the outer envelope of the rotor trochoidal peripheral surface 14. That is, the surface 32 is the outer envelope of the various positions of the rotor peripheral surface 14 relative to the rotor housing 26. The resulting peripheral surface 32 has two waist portions 34 which, in effect, generate the hypotrochoidal surface 14 as the rotor rotates relative to rotor housing 26. Therefore, each of the two waist portions 34 is effect is a generating line (herein termed generating element) which extends axially across the rotor housing 26 and generates the hypotrochoid rotor surface 14 as the rotor 12 rotates relative to its rotor housing 26. A slight clearance preferably is provided between the rotor 12 and housing peripheral surface 32 to avoid any mechanical interference which might otherwise result because of such factors as bearing clearances and manufacturing tolerances. This clearance has been exaggerated in the drawing for purpose of illustration.

The rotary compressor 10 is also provided with an intake port 40 and an outlet or exhaust port 42 disposed on opposite sides of each hypotrochoid generating element 34. Each exhaust port 42 preferably is provided with a check valve schematically shown at 43 to prevent reverse flow into the compressor.

With the structure described, a plurality of working chambers 44 are formed between the rotor 12 and rotor housing 26. Each of these chambers extend circumferentially from a rotor apex portion 16 to another apex portion or to a hypotrochoid generating element 34. If the shaft 20 rotates in a clockwise direction as viewed in FIG. 1, the rotor 12 also rotates clockwise but at one third the speed of the shaft. As the rotor 12 rotates, fluid is drawn in through the lower left-hand intake port 40 and into a working chamber 44 and fluid is being pumped out through the upper left-hand exhaust port 42 from another working chamber 44 and at the same time fluid is similarly being drawn in through the upper right-hand intake port 40 and is being pumped out through the lower right-hand exhaust port 42. Thus, each half of the rotary mechanism 10 on opposite sides of a vertical plane through the generating elements 34 functions as a compressor. The structure so far described is conventional.

For efficient compressor operation, adequate sealing must be provided between each generating element 34 and the trochoidal surface 14 of the rotor 12 and between each rotor apex 16 and the inner peripheral surface 32 of the rotor housing as well as between the sides of the rotor 12 and the adjacent end walls 22 and 24.

In accordance with the invention and as best seen in FIGS. 3–5, the hypotrochoidal peripheral surface 14 of the rotor 12 is provided with a plurality of closely spaced labyrinth-type grooves or recesses 50 extending axially across said surface. The grooves 50 may be machined directly into the rotor peripheral surface 14 or they may be formed on the external surface of a material such as metal or plastic attached (as by bonding) to the rotor surface 14. By providing these grooves 50, a labyrinth seal is provided between each generating element 34 and the hypotrochoidal surface 14, as well as between the apex portions 16 of the rotor and the inner peripheral surface 32 of the rotor housing. In addition, each end face of the rotor 12 is provided with a plurality of elongated grooves or recesses 52 adjacent and parallel to the rotor periphery and extending circumferentially between rotor apex portions 16. Also each rotor end face has one or more grooves 54 extending radially inwardly from each rotor apex portion 16. As in the case of the grooves 50, the grooves 52 and 54 may be machined into a rotor end face or these grooves may be formed in one or more separate plates secured to a rotor end face. The grooves 50 thereby inhibit leakage from the working chambers 44 between the rotor and the generating elements 34 and between the apex portions 16 of the rotor and the inner peripheral surface 32 of the rotor housing while the grooves 52 and 54 in the rotor end surfaces inhibit such leakage through the small clearance between the rotor end faces and the housing end walls 22 and 24. In this way each working chamber 44 is effectively sealed without requiring mechanical contact between the rotor 12 and the adjacent walls of the housing 22, 24 and 26.

To further increase the effectiveness of this labyrinth seal grid around each working chamber 44, the inner peripheral surface 32 of the rotor housing may, as shown in FIG. 3, also be provided with labyrinth-type grooves 56 extending axially across this surface. The labyrinth grooves 56 may be in addition to or in lieu of the labyrinth grooves 50 on the rotor peripheral surface 14. Also, the grooves 56 may be machined directly in the surface 32 of the rotor housing or they may be formed in a single or multi-piece liner of suitable material, such as metal or plastic, and bonded to the housing.

In order to prevent oil escaping from the rotor bearing 17 from leaking radially outwardly between the rotor and the housing end walls 22 and 24, the rotor end faces are provided with one or more annular oil seals 60 received in grooves in the rotor end faces and urged axially by springs (not shown) against the adjacent housing end walls 22 and 24.

FIGS. 6, 7, 8 and 9 show a modified form of the invention in which the rotor housing is provided with radially movable seal bars or strips to form the hypotrochoid generating elements. For ease of understanding, the parts of FIGS. 6, 7, 8 and 9 have been designated by the same reference numerals as the parts of the embodiment of FIGS. 1–6 but with a subscript *a* added thereto.

In the embodiment of FIGS. 6, 7, 8 and 9, a radially movable seal strip or bar 34*a* is placed at each hypotrochoid generating line or element of the rotor housing 26*a*. Each seal bar 34*a* is received within a radial groove 70 extending axially across the rotor housing and a spring 72 at the bottom of the groove urges the seal bar 34*a* radially inwardly into continuous contact with the hypotrochoidal peripheral surface 14*a* of the rotor 12*a*.

Figure 8:
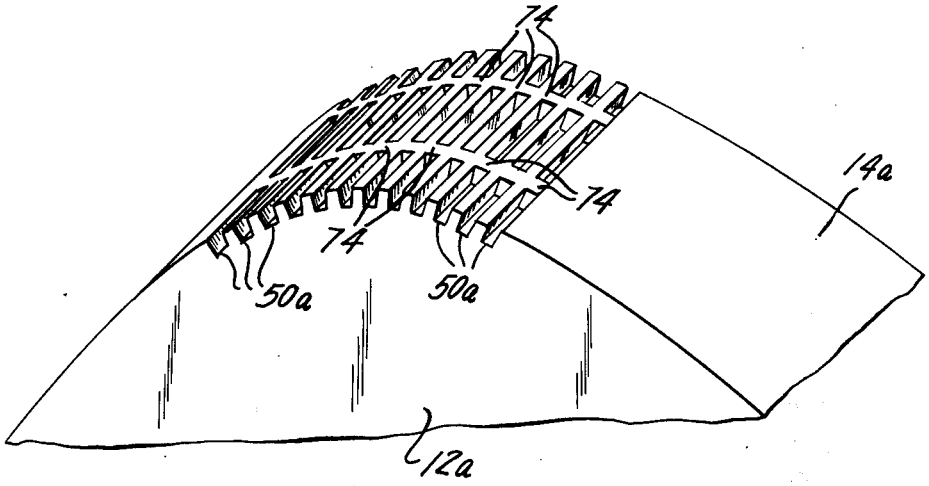
FIG. 8 is an enlarged perspective of a portion of FIG. 6.

The seal bar 34*a* thereby seal one end of each working chamber 44*a* at each waist portion of the rotor housing peripheral surface 32*a*. In order to seal the other end of each working chamber, each rotor nose or apex portion 16*a* is provided with labyrinth grooves 50*a* parallel to the rotor axis. The grooves 50*a* need be provided only over that part of each rotor nose portion which comes in close sealing relation with the rotor housing peripheral surface 32*a*. That is, as shown in FIGS. 6 and 8, the balance of the peripheral surface of the rotor 14*a* need not be provided with the labyrinth groove 50*a* and preferably is not provided with such grooves. Each of the labyrinth grooves 50*a* preferably is interrupted by one or more lands 74 (see FIG. 8) flush with the hypotrochoid rotor surface 14*a* to form rails on which the seal bars 34*a* can ride without mechanical interference from the rotor grooves 50*a*. In lieu of the lands 74, the grooves 50*a* may be inclined to the axial direction so as to avoid mechanical interference with the seal bars 34*a* as hereinafter described in connection with FIG. 11.

The two end faces of the rotor 12*a* are provided with a labyrinth sealing configuration (not shown in FIGS. 6, 7 and 8) similar to that shown in FIG. 3 so as to complete the sealing grid around each working chamber 44*a*. Also the end faces of the rotor 12*a* may be provided with one or more oil seal rings 60*a* as in FIGS. 1–3.

Each housing seal bar 34*a* preferably is provided with a rounded tip portion in order to minimize wear of this tip portion as it slides over the rotor surface 14*a*. As a result of rotation of the rotor 12*a* relative to the rotor housing 26*a*, the seal bar is not always perpendicular to the rotor surface 14*a* and in general makes an angle with this surface which varies as the rotor rotates. Because of this angular variation of the seal bar 34*a* relative to the rotor surface and because the tip of the seal bar is rounded, the seal bar must shift radially in its slot 70 to maintain contact with the rotor surface if this surface is a true hypotrochoid. This radial motion of the seal bar is objectionable because it involves frictional sliding of the seal bar along a side of its groove 70. Theoretically, this radial motion could be eliminated by providing the seal bar with a pointed tip. This is impractical, however, since such a pointed tip would quickly wear to a blunt tip.

Figure 9:
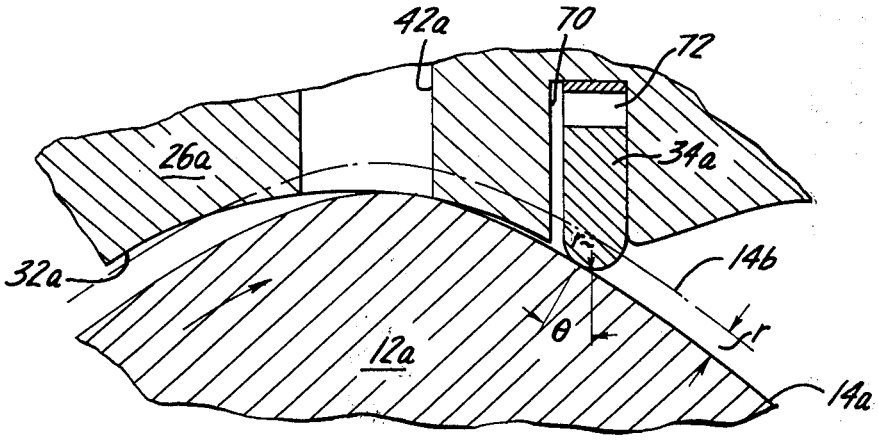
FIG. 9 is an enlarged view of a sealing bar and adjacent rotor and housing portions of FIG. 6.

To avoid this problem and, as illustrated in FIG. 9, the tip of each seal bar 34*a* preferably is rounded with a radius *r* and the surface 14*a* of the rotor 12*a* instead of being made a true hypotrochoid is made parallel to a theoretical hypotrochoid 14*b* generated by each point 76 which is the center of curvature of the rounded tip of its seal bar 34*a*, the surface 14*a* being displaced radially inwardly of the theoretical hypotrochoid 14*b* by said distance *r*. This seal tip construction is similar to that shown in British Pat. No. 1,154,090 granted June 4, 1969 to Huf, but for a rotor having an epitrochoidal peripheral surface rather than a hypotrochoid. With this construction, the point 76 will generate a true or theoretical hypotrochoid as the rotor rotates. At the same time since the rotor surface 14*a* is parallel to the true hypotrochoid by a distance *r* which is the same as the tip radius of the seal bar, no radial motion of the seal bar 34*a* is required to maintain sealing contact with the rotor surface 14*a*. Some radial motion of the seal bar 34*a* will, of course, take place in actual practice because of such factors as manufacturing tolerances and bearing clearances. Also, since the distance *r* is small and since the rotor peripheral surface 14*a* is parallel to a true hypotrochoid, the surface 14*a* is substantially a hypotrochoid. As in FIG. 1, the rotor housing surface 32*a* is the outer envelope of the various positions of the rotor peripheral surface 14*a* relative to the rotor housing 26*a*. For ease of illustration, in FIG. 9 a check valve has been omitted from the outlet port 42*a* and the labyrinth grooves 50*a* have been omitted.

FIG. 9 also illustrates the rotor 12*a* in a position in which a nose portion 16*a* of the rotor is moving past a discharge port 42*a*. That is, the rotor is in a position in which it has just completed discharge of a working chamber 44*a* through the exhaust port 42*a*. As illustrated in FIG. 9, with the rotor 12*a* in this position, the seal between the rotor nose portion 16*a* and the adjacent portion of the rotor housing has almost reached the stationary housing seal 34*a* so that the circumferential distance between these seal points is approached a small value. This fact, coupled with the close fit between the rotor periphery 14*a* and the housing surface 32*a*, results in the volume of this working chamber 44*a*, which has just completed its discharge, being substantially zero. This obviously is also true of the compressor 10 of FIG. 1. As a result, the compressors 10 and 10*a* of the present invention have a high volumetric efficiency.

The fact that the circumferential dimension as well as the radial dimension of each working chamber 44 or 44*a* decreases during the compression stroke is a distinct advantage over conventional piston-type compressors or in compressors of the type shown in U.S. Pat. No. 3,226,013 (FIGS. 21 or 23) granted Dec. 28, 1965 to Toyoda et al. or in U.S. Pat. No. 724,665 granted Apr. 7, 1903 to Cooley and generally known as a Cooley-type compressor. In such prior art compressors only the radial dimension of the compressor working chambers decreases during the compression stroke and as a result their minimum volume cannot be reduced to the same extent as in compressors of this invention. In this latter connection it is noted that in a Cooley-type compressor the rotor has an epitrochoidal surface which, in the minimum volume position of a working chamber, theoretically can be made to fit very close to the adjacent portion of the rotor housing. However, in order to facilitate fluid flow from each working chamber into the outlet port, and to avoid mechanical interference between the rotor and rotor housing, a significant minimum volume must be provided between the rotor and rotor housing of a Cooley-type compressor.

In the above discussion of volumetric efficiency of the compressor 10 or 10*a* of the present invention, it is assumed that the check valve 43 or 43*a* in each compressor outlet port is disposed close to the inner peripheral surface 32 or 32*a* of the rotor housing so that the volume of the space between the check valve and said inner peripheral surface of the rotor housing is small.

In lieu of or in addition to the labyrinth seal grooves 50*a* of FIG. 6 disposed about the nose or apex portions 16*a* of the rotor 12*a*, labyrinth seal grooves 56*a* extending axially across the housing surface 32*a* may be provided. Such a modification is illustrated in FIG. 10. The parts of FIG. 10 have been designated by the same reference numerals as the corresponding parts of FIG. 6.

In FIG. 10 the labyrinth grooves 56*a* are disposed over the entire rotor housing surface 32*a*. With this arrangement the grooves 56*a* provide a labyrinth seal between each rotor nose portion 16*a* and the rotor housing, in all positions of the rotor, regardless of whether or not each rotor nose portion 16*a* is also provided with labyrinth grooves 50*a* as in FIG. 6. The sealing grid provided for each working chamber 44*a* in FIG. 10 is otherwise similar to that provided in FIG. 6.

As described in connection with FIG. 8, the apex portion seal grooves 50*a* are interrupted by lands 74 to avoid mechanical interference with the seal bars 34*a*. This interference can also be avoided by shaping or orientating the grooves so that they are not parallel to the rotor axis. Such an arrangement is illustrated in the plan view of the rotor in FIG. 11 in which the seal grooves 50*a* are replaced by grooves 50*b* which, as illustrated, are inclined to the rotor axis and therefore are inclined to the seal bars 34*a* as they pass under these seal bars. Instead of so inclining the grooves 50*a* they could, for example, have an arcuate or chevron shape as viewed in FIG. 11.

The labyrinth seal configurations disclosed herein will, of course, permit some leakage of the circumferential ends of each working chamber 44 or 44*a* particularly as a result of the pressure fluid in each labyrinth groove 50 and 50*a* as the groove moves past a seal generating element 34 or 34*a*. Such leakage, however, should be small. To minimize leakage past the labyrinth seals, the running clearance of the labyrinth seals between the compressor rotor 12 (or 12*a*) and the housing 22, 24, 26 (or 22*a*, 24*a*, 26*a*) should be kept to a minimum. For this purpose, and as has already been mentioned, the ribs or teeth between the labyrinth seal grooves may be made slightly oversize in depth so as to provide a slight interference fit which will wear in during initial operation of the compressor. For example, in FIG. 1 the ribs or teeth between the labyrinth grooves 50 may be fabricated so as to have their outer edges which project outwardly slightly beyond the desired rotor surface 14 such that these ribs or teeth will interfere slightly with the internal surface 32 of the rotor housing 26 and as a result will wear down during initial operation of the compressor. with such a wear in fit for the labyrinth seals the tip clearance of the labyrinth seal is kept to a minimum and therefore any leakage across these seals will be minimized. With labyrinth grooves on the surface 14 or 14*a* of the rotor, some leakage results from fluid carried around by these grooves past the hypotrochoid generating elements 34 or 34*a*. This leakage, however, would not occur if in lieu of labyrinth grooves 50 or 50*a* on the rotor peripheral surface, labyrinth grooves are provided only on the inner peripheral surface of the rotor housing as illustrated in FIG. 10.

The effectiveness of the labyrinth seal grooves provided in the various modifications described depends on the depth and width dimensions as well as on the labyrinth seal tip clearance. Approximate typical relative magnitudes of these dimensions are illustrated in FIG. 12 in connection with the labyrinth grooves 50 on the rotor surface 14 in FIG. 1. As there illustrated, *d*1 is the tip clearance between the outer edges of the ribs or teeth 80 formed between the labyrinth grooves 50 and the adjacent surface 32 of the rotor housing 26. As already stated, this tip clearance *d*1 is made as small as is practical. The width *d*2 of each labyrinth seal groove 50 at its outer edge is made at least about ten times the labyrinth tip clearance dimension *d*1 and the depth *d*3 of each groove 50 is made at least about fifteen times the tip clearance *d*1. The actual magnitudes of the labyrinth seal dimensions *d*1, *d*2 and *d*3, as well as their relative magnitudes, will vary with many factors such as the seal pressure differential, compressor speed and size. The tip or outer edges of each rib or tooth 80 is made as thin as practical but each tooth 80 preferably widens toward the base for reasons of strength. The other labyrinth seal grooves, as illustrated, namely grooves 52 54, 56, 50*a* and 56*a* and the teeth formed between these grooves along with the tip clearance preferably have similar relative dimensions.

As already noted, although the invention has been described in terms of compressor operation, the invention is equally applicable to expansion engines. Also, the invention is not limited to the specific geometric configuration illustrated. For example, the hypotrochoid surface of the rotor could be provided with a different number of apex portions by changing the diameters of the rolling circles from which the hypotrochoid is generated. Thus, instead of three apex portions, as illustrated, the rotor could have only two such apex portions or it could have more than three such portions with the inner surface of the rotor housing being the outer envelope of the various portions of the rotor as the rotor rotates. In addition, instead of the compressor intake and exhaust ports being in the rotor housing, as illustrated, they could be placed in one or both of the housing end walls. Also, while each of the labyrinth seals have been illustrated as comprising elongated grooves, each of said grooves could be replaced by a series of hole-like recesses. Thus as used herein the term "labyrinth-type recesses" means any series of recesses which provide many successive regions for local pressure drops.

While the invention has been described in detail in its present preferred embodiments, it is obvious to those skilled in the art, after understanding the invention, that various changes and modifications may be made therein without departing from the spirit and scope thereof. The appended claims are intended to cover such modifications.

What is claimed is:

1. A rotary mechanism such as a compressor, expansion engine or the like comprising:

a. an outer body comprising a pair of axially-spaced end walls and an intermediate wall defining a cavity therebetween;

b. an inner body mounted for relative rotation within said cavity and having its axis eccentric to the axis of said outer body, the peripheral surface of said inner body having a plurality of nose portions and being substantially a hypotrochoid and the inner peripheral surface of said outer body intermediate wall being substantially the outer envelope of the peripheral surface of the inner body such that a plurality of fluid working chambers are formed between said inner body and said intermediate wall peripheral surface;

c. at least one radially-movable seal strip carried by said intermediate wall and disposed parallel to the axis of said mechanism at a position such that the inner edge of said strip substantially generates the hypotrochoidal peripheral surface of the inner body during relative rotation of said bodies and means for urging said seal strip radially inwardly into sealing engagement with said hypotrochoidal peripheral surface;

d. said outer body having intake and outlet ports for communication with said working chambers and disposed on opposite sides of said seal strip; and e. at least one of said peripheral surfaces having labyrinth-type recesses over at least a portion of said surfaces to provide sealing cooperation between the nose portions of the inner body and said intermediate wall peripheral surface.

2. A rotary mechanism as claimed in claim 1 and in which the inner surface of said intermediate wall is provided with said labyrinth-type recesses.

3. A rotary mechanism as claimed in claim 1 in which the hypotrochoidal peripheral surface of the inner body has three nose portions and said mechanism includes a second radially-movable seal strip similar to said first mentioned seal strip but disposed diametrically opposite to said mentioned seal strip.

4. A rotary mechanism as claimed in claim 1 and in which the inner edge of the seal strip has a convex curvature in planes transverse to the axis of the mechanism and the peripheral surface of the inner body in parallel to a true hypotrochoid generated by the center of said curvature and is displaced radially inwardly of said true hypotrochoid by a distance approximately equal to the radius of said curvature.

5. A rotary mechanism as claimed in claim 1 and in which at least one of the end surfaces of the inner body is provided with labyrinth-type recesses disposed over a substantial portion of said end surface for sealing cooperation with the adjacent end wall of the outer body.

6. A rotary mechanism as claimed in claim 1 in which the nose portions of said hypotrochoidal peripheral surface are provided with said labyrinth-type recesses.

7. A rotary mechanism as claimed in claim 6 and in which the labyrinth-type recesses on the nose portions of the inner body hypotrochoidal surface extend for a sufficient distance circumferentially beyond both sides of each nose portion of the inner body to provide a labyrinth seal between each said nose portion and the intermediate wall peripheral surface in all positions of the inner body relative to the outer body.

8. A rotary mechanism as claimed in claim 7 in which said labyrinth-type recesses comprise a plurality of elongated grooves extending axially across the nose portions of the inner body and in which each of said grooves has one or more land portions flush with the hypotrochoidal peripheral surface of the inner body.

9. A rotary mechanism as claimed in claim 7 and in which said labyrinth-type recesses comprise a plurality of elongated grooves which are non-parallel to said seal strip.

10. A rotary mechanism as claimed in claim 7 in which the said inner body hypotrochoidal peripheral surface has three equally-spaced nose portions and said mechanism includes a second radially-movable seal strip similar to said first-mentioned seal strip but disposed diametrically opposite to said first-mentioned seal strip.

* * * * *